US006488289B2

(12) United States Patent
Hsiao et al.

(10) Patent No.: US 6,488,289 B2
(45) Date of Patent: Dec. 3, 2002

(54) BI-FUNCTIONAL ROLLER SKATE

(76) Inventors: Chun-Chung Hsiao, No. 22, Lane 58, Da Yun St. Yuan Lin Chen, Changhua Hsien (TW); Hung-Lung Huang, 10 Fl. No. 28, Wen Chung Rd., Kaohsiung (TW); Jong-Ming Lee, No. 12, Kuang Chien Rd. Bei Tou Chen, Changhua Hsien (TW)

( * ) Notice: Subject to any disclaimer, the term of this patent is extended or adjusted under 35 U.S.C. 154(b) by 0 days.

(21) Appl. No.: 09/801,789

(22) Filed: Mar. 9, 2001

(65) Prior Publication Data

US 2002/0125655 A1 Sep. 12, 2002

(51) Int. Cl.[7] ..... A63C 17/14; A63C 17/20

(52) U.S. Cl. ..... 280/11.208; 280/11.223; 280/11.27; 301/5.305

(58) Field of Search ..... 280/7.13, 11.204, 280/11.207, 11.19, 11.208, 11.27, 11.3, 11.34, 11.223; 301/5.305, 124.2, 111.01

(56) References Cited

U.S. PATENT DOCUMENTS 3,387,852 A * 6/1968 Sarro ..... 280/11.19
4,596,396 A * 6/1986 Merbler ..... 280/11.3
5,372,383 A * 12/1994 Kubierschky ..... 280/11.23
5,398,970 A * 3/1995 Tucky ..... 280/841
5,441,286 A * 8/1995 Pozzobon ..... 280/11.28
5,462,295 A * 10/1995 Seltzer ..... 280/11.19
5,511,824 A * 4/1996 Kim ..... 280/11.19
5,772,220 A * 6/1998 Gaster ..... 280/7.1
5,800,022 A * 9/1998 Del Rosario ..... 280/11.22
5,964,537 A * 10/1999 Hill, Jr. ..... 280/11.22
6,213,480 B1 * 4/2001 Rodriguez ..... 280/11.204
6,354,609 B1 * 3/2002 Chen et al. ..... 280/11.3

* cited by examiner

*Primary Examiner*—Brian L. Johnson
*Assistant Examiner*—Jeffrey Restifo
(74) *Attorney, Agent, or Firm*—Bacon & Thomas

(57) ABSTRACT

A simply structured bi-functional roller skate has a pair of shoe embodiments. Each shoe embodiment is provided with a front securing seat which is a tubular device with a forwardly extended board, and a rear securing seat which is a tubular device with a backwardly extended board. Both the front and rear securing seats are embedded at the front end and the rear end of each shoe embodiment respectively. Each tubular device of the front and rear securing seats is in alignment with an engagement hole so as to permit a first and a second wheel axle each having a proper length to be led therethrough at the front and rear end of a shoe embodiment. Each wheel axle has a knob-ended locking screw at one end and an internally threaded section at the other end so as to permit the knob ended locking screw to be secured to the end of each wheel axle after roller wheels are mounted to the wheel axles respectively. The brake block has a threaded rod so as to make the brake block engage internally threaded holes defined at the front and rear securing seats respectively.

1 Claim, 4 Drawing Sheets

BI-FUNCTIONAL ROLLER SKATE

BACKGROUND OF THE INVENTION

The present invention relates to a simply structured bi-functional roller skate which has a shoe that can be converted from a roller skate into a common shoe, the roller skate and common shoe being referred to herein as shoe embodiments. In each shoe embodiment, the shoe is provided with a front securing seat which is a tubular device with a forwardly extended plate, and a rear securing seat which is a tubular device with a backwardly extended plate. Both the front and rear securing seats are embedded at the front end and the rear end of each shoe embodiment respectively. Each tubular device of the front and rear securing seats is in alignment with an engagement hole so as to permit a first and a second wheel axle each having a proper length to be led therethrough at the front and rear end of the shoe embodiment. Each wheel axle has a knob-ended locking screw at one end and an internally threaded section at the other end so as to permit the knob-ended locking screw to be secured to the end of each wheel axle after roller wheels are mounted to the wheel axles respectively. The brake block has a threaded rod so as to make the brake block engage an internally threaded hole defined at the front securing seat.

The present invention provides an improved bi-functional roller skate which can be converted into a common shoe for wearing as a walking means and be easily transformed into a roller skate for skating purposes so as to permit a user to move with speed and ease. It has shorter roller-mounted axles so that accidental collision and damage of the axles can be effectively prevented in use, resulting in longer durability in operation.

Referring to FIG. 1, a prior art bi-functional roller skate has a pair of shoe embodiments 80. Each shoe embodiment 80 is equipped with a pair of wheel axles 81, two springs 82, two locking pins 84 and four roller wheels 85. A pair of axle tubes 801 embedded at the front and rear end of each shoe embodiment 80 match with the lengths of the wheel axles 81 respectively. Each wheel axle 81 has a bulged head at one end 811 and a bifurcated end 812 having a pin hole 813 defined thereon so as to permit a positioning plate 83 whose thickness matches with the width of the bifurcated end 812 to be retained in the bifurcated end 812 by the pin 84. Four roller wheels 85 each having a bearing 852 at its central axle hole 851 are mounted onto the wheel axles 81 and are retained in position by way of the positioning plate 83 which is locked in place by the pin 84. The spring 82 is in abutment against the bulged head and forces the wheel axle 81 to separate from the shoe body in nature so as to make the positioning plate 83 be firmly retained in place against a right roller wheel 85.

Such a prior art bi-functional roller skate has the following disadvantages in practical use:

1. The wheel axles 81 are easily disengaged from the shoe embodiment as a result of failure of the spring 82 due to long period of use.
2. The positioning plate 83 is easily disengaged from the wheel axle 81 when the bulged head 811 of the wheel axle 81 accidentally comes into collision against a foreign object, forcing the spring 82 to be compressed and let the positioning plate 83 free.

SUMMARY OF THE INVENTION

Therefore, the primary object of the present invention is to provide an improved bi-functional roller skate which is provided with a wheel axle having an internally threaded end so as to permit a knob-ended screw to be readily secured to the end of the wheel axle with roller wheels to be safely and firmly mounted to the sides of a roller skate shoe embodiment and easily dismounted for maintenance.

Another object of the present invention is to provide an improved bi-functional roller skate which is provided with wheel axles that are short enough and protected by knob-ended covers so as to protect the wheel axles from accidental damage during a collision, to prevent separation of the roller wheels, and to make the appearance of the roller skate is more appealing to users' eyes.

DETAILED DESCRIPTION OF THE PREFERRED EMBODIMENT

Figure 1:
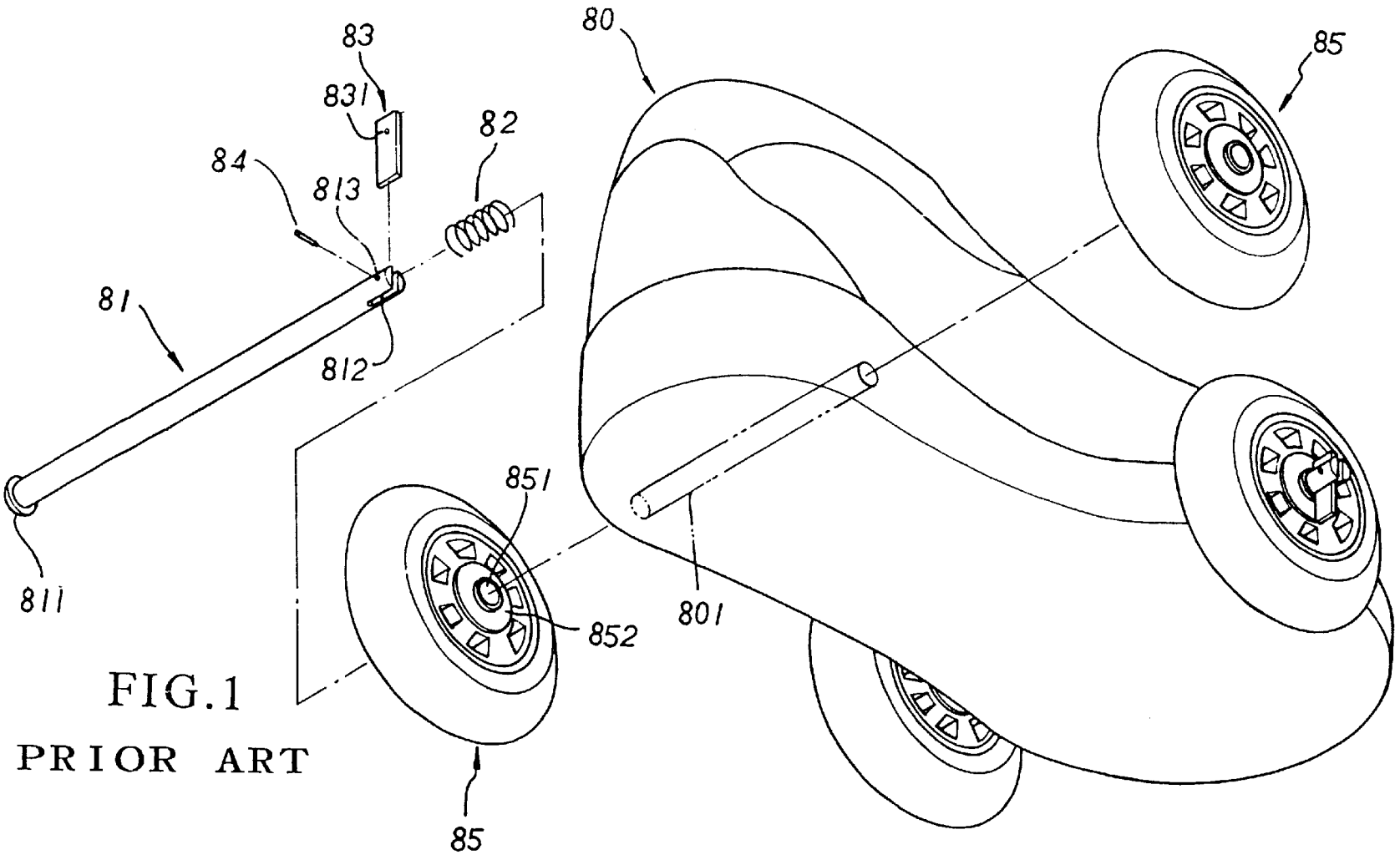
FIG. 1 PRIOR ART
FIG. 1 is a diagram showing a prior art roller skate.
Figure 2:
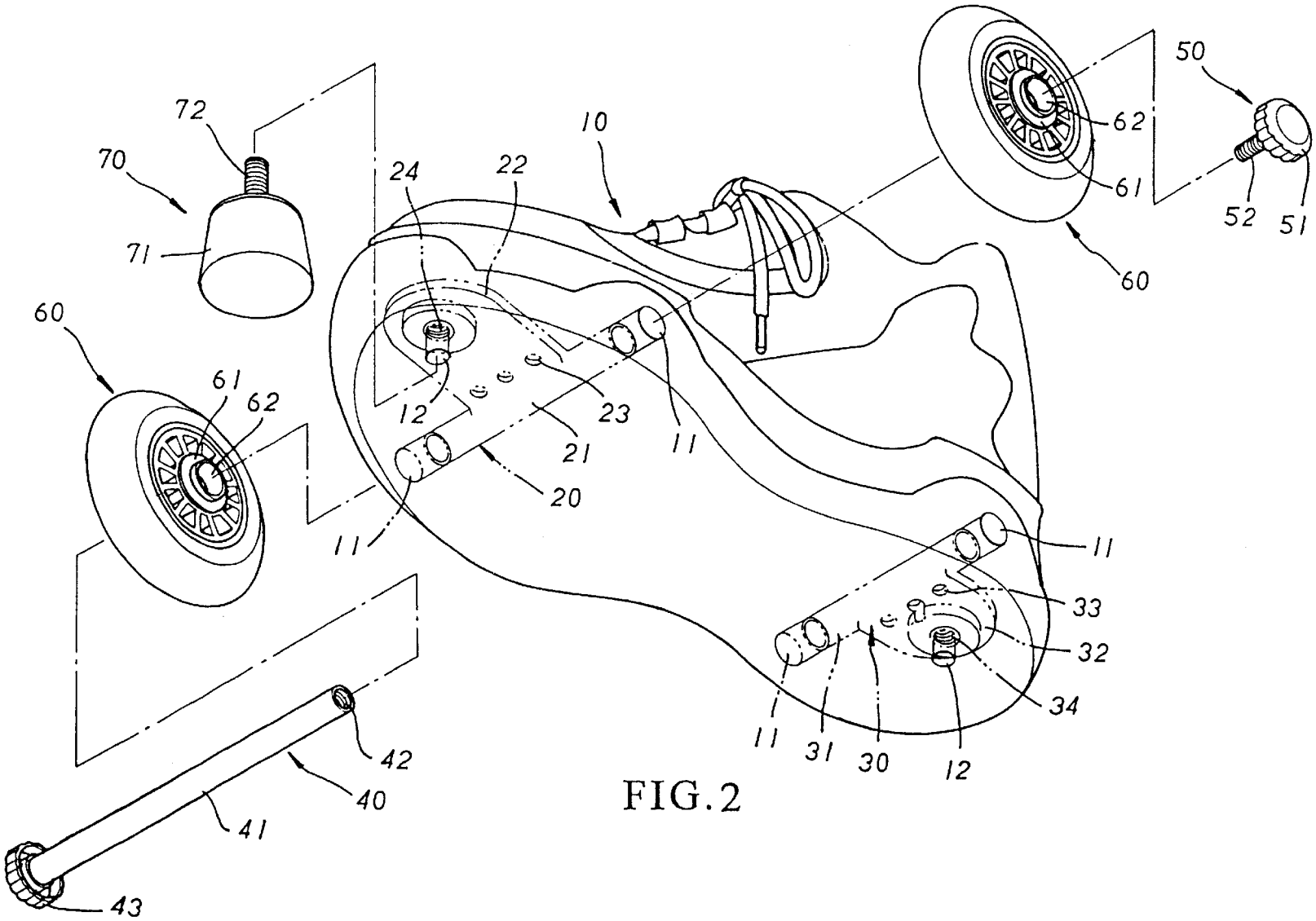
FIG. 2 is a perspective diagram showing the exploded components of the present invention.
Figure 3:
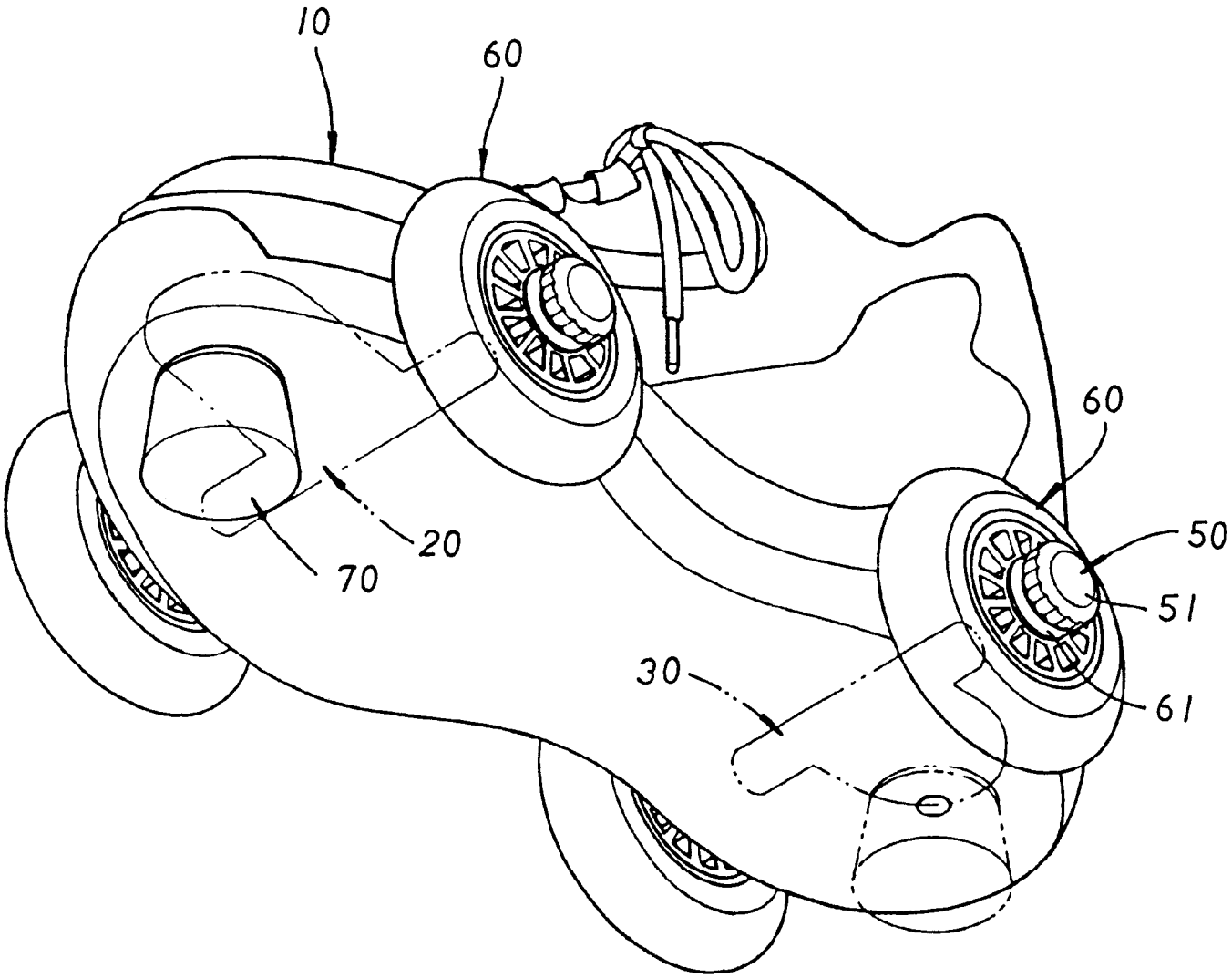
FIG. 3 is a perspective diagram showing the assembly of the roller skate of the present invention.
Figure 4:
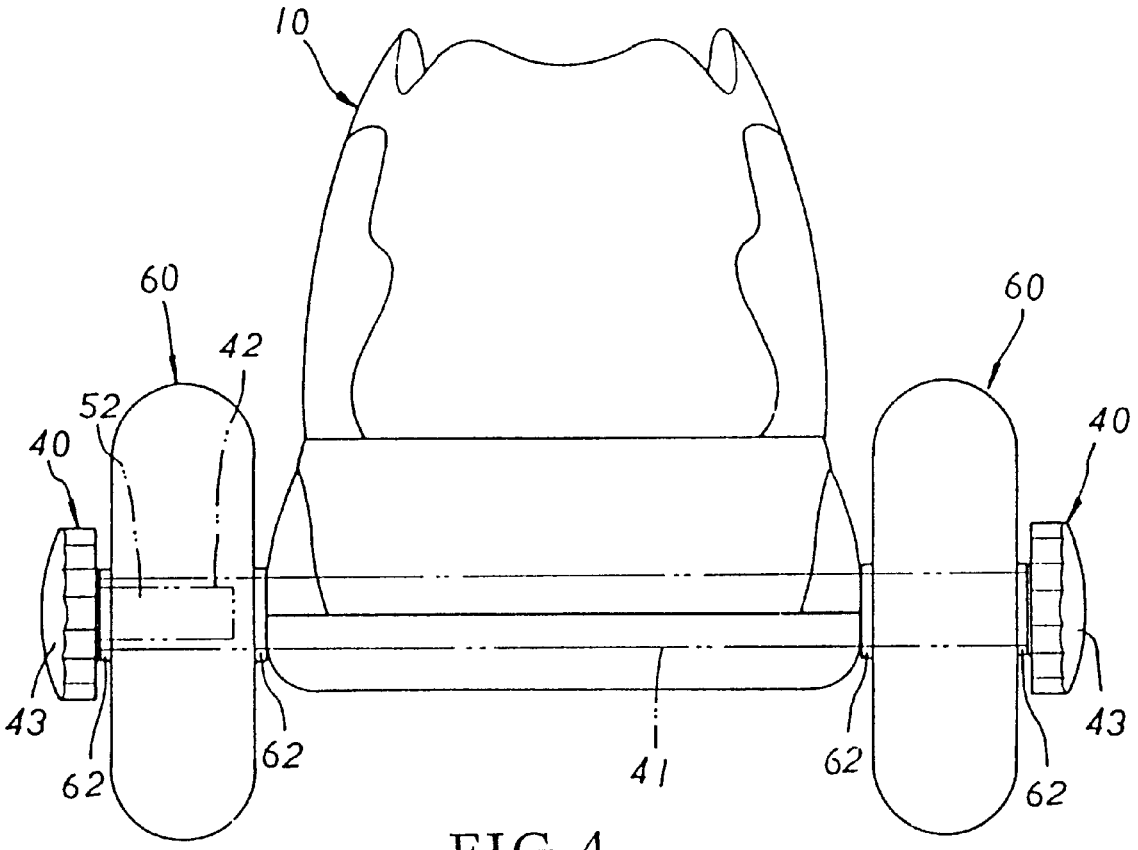
FIG. 4 is a rear side view of the roller skate of the present invention.

Referring to FIG. 2, the roller skate has a pair of shoe embodiments 10. Each shoe embodiment 10 is equipped with a front securing seat 20, a rear securing seat 30, a pair of wheel axles 40, a pair of locking screws 50, four roller wheels 60 and a pair of brake pieces 70.

The front securing seat 20 is embedded at the front end and the rear securing seat 30 is embedded at the rear end of the shoe embodiment 10. The shoe embodiment 10 is provided with a through hole 11 at each side thereof at the front end and rear end respectively. On the bottom of the shoe embodiment 10 arc disposed a mounting hole 12 at the front and the end heel portions thereof. The front securing seat 20 is provided with a tube 21 at the rear portion thereof which is positioned in alignment with a pair of through holes 11 of the shoe embodiment 10. The tube 21 is integrally connected to an extension plate 22 which is embedded at the front end of the shoe embodiment and is provided with an internally screwed locking hole 24 positioned in alignment with the mounting hole 12 of the shoe embodiment 10. There are a plurality of engagement holes 23 defined on the extension plate 22 so as to enable fixing of the front securing seat 20 to the shoe embodiment 10 in a more secure manner.

The rear securing seat 30 is provided with an axle tube 31 at the front thereof which is positioned in alignment with the through holes 11 of the shoe embodiment 10. An extension plate 32 integrally connected to the axle tube 31 is embedded in the heel portion of the shoe embodiment 10. There are a plurality of engagement holes 23 defined right at the joint of the axle tube 31 and the extension plate 32 for better retention of the rear securing seat 30 in the shoe embodiment 10. An internally threaded hole 34 defined on the extension plate 32 is positioned in alignment with the mounting hole 12 of the shoe embodiment 10.

The two wheel axles 40 are two rods 41 sized to match with the respective width of the front portion and heel portion of the shoe embodiment 10. One end of the axle rods 41 is provided with a knob 43 and the other end is provided with an internally threaded hole 42 so as to permit a locking screw 50 which has a thread section 52 and a driving knob 51.

Each roller wheel 60 has a hub flange 62 and a bearing 61 at each side thereof The brake piece 70 is a plastic block 71 having a protruded bolt 72 at the top thereof.

In assembly, a roller 60 is first engaged with the rod 41 of each wheel axle 40 with the roller 60 located in abutment with the knob 43 and then the rod 41 is guided through the through hole 11 and the tube 21 and the opposite through hole 11 of the shoe embodiment 10. Then, the other roller 60 is attached to the exposed end of rod 41 and locked in place by way of the knob-ended screw 50. In the same manner, the other wheel axle 41 is mounted to the shoe embodiment 10, as shown in FIG. 5. The brake pieces 70 are secured to the bottom of the shoe embodiment 10 with the bolts 72 of the brake block 71 led through the mounting holes 12 and engaged with the internally threaded locking holes 24, 34 of the shoe embodiment 10 respectively.

In summary, the present invention has the following advantages in practical operation:

1. The rollers 60 are easily and firmly mounted to the wheel axles 40 and retained in place by knob ends 43 and 51; such a structure can prevent the rollers from disengagement of the wheel axles and damage in use.
2. The wheel axles 40 are designed short enough to cause the rollers 60 to be in as close abutment against the shoe embodiment as possible, and enable the knob ends 43, 51 to well protect the ends of the wheel axles from damage, allowing the roller skate to be durable in use.

We claim:

1. A bi-functional roller skate, comprising:

a shoe, a front securing seat, a rear securing seat, a pair of wheel axles, a pair of locking screws, four roller wheels and a pair of brake pieces; wherein said front securing seat is embedded at a front end and said rear securing seat is embedded at a rear end of said shoe;

said shoe is provided with a through hole at each side thereof at said front end and rear end respectively; on a bottom of said shoe is disposed a first mounting hole at said front and said rear end portions thereof respectively;

said front securing seat is provided with a tube at said rear end thereof which is positioned in alignment with a pair of through holes of said shoe; said tube is integrally connected to a first extension plate which is embedded at said front end of said shoe and is provided with an internally screwed locking hole positioned in alignment with said first mounting hole of said shoe for mounting a brake piece; and a plurality of engagement holes are defined on said first extension plate so as to make the fixing of said front securing seat to said shoe in a more secure manner;

said rear securing seat is provided with an axle tube at a front thereof which is positioned in alignment with said through holes defined at said rear end of said shoe; a second extension plate integrally connected to said axle tube is embedded in said rear end portion of said shoe; and a plurality of engagement holes are defined at a joint of said axle tube and said second extension plate for better retention of said rear securing seat in said shoe; and an internally threaded hole defined on said second extension plate is positioned in alignment with said second mounting hole of said shoe;

wherein said roller skate is characterized in that said two wheel axles are two rods sized to match with the respective width of the front end portion and said rear end portion of said shoe; one end of said axle rods is provided with a knob and the other end is provided with an internally threaded hole so as to permit a locking screw which has a thread section and a driving knob; and wherein a roller is engaged with said rod in one of said wheel axles, the roller being located in abutment with said knob; said rod extends through said through hole, said tube, and said opposite through hole of said shoe; and another roller is attached to an exposed end of said rod and locked in place by way of said knob-ended screw.

* * * * *